US007931730B2

(12) United States Patent
Lee et al.

(10) Patent No.: US 7,931,730 B2
(45) Date of Patent: Apr. 26, 2011

(54) METHOD FOR MANUFACTURING METAL NANOPARTICLES

(75) Inventors: Kwi-Jong Lee, Hwaseong-si (KR); Jaewoo Joung, Suwon-si (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 423 days.

(21) Appl. No.: 12/149,198

(22) Filed: Apr. 29, 2008

(65) Prior Publication Data

US 2009/0031856 A1 Feb. 5, 2009

(30) Foreign Application Priority Data

Jul. 30, 2007 (KR) ..... 10-2007-0076556

(51) Int. Cl.
*B22F 9/24* (2006.01)

(52) U.S. Cl. ..... 75/371; 75/723; 977/896

(58) Field of Classification Search ..... 75/371
See application file for complete search history.

(56) References Cited

U.S. PATENT DOCUMENTS

| | | | | |
|---|---|---|---|---|
| 7,628,840 | B2 * | 12/2009 | Atsuki et al. | 75/717 |
| 2005/0235776 | A1 * | 10/2005 | He et al. | 75/255 |
| 2008/0206562 | A1 * | 8/2008 | Stucky et al. | 428/403 |
| 2009/0029148 | A1 * | 1/2009 | Hashimoto et al. | 428/323 |

FOREIGN PATENT DOCUMENTS

| | | |
|---|---|---|
| JP | 2005-036309 | 2/2005 |
| JP | 2007-084879 | 4/2007 |
| WO | WO-2007/034922 A1 * | 3/2007 |

OTHER PUBLICATIONS

Korean Office Action, with Partial English Translation, issued in Korean Patent Application No. KR 10-2007-0076556, dated Nov. 28, 2008.

* cited by examiner

*Primary Examiner* — George Wyszomierski
(74) *Attorney, Agent, or Firm* — McDermott Will & Emery LLP

(57) ABSTRACT

The present invention provides a method for manufacturing metal nanoparticles, comprising: dissociating at least one metal precursor selected from the group consisting of silver, gold and palladium; reducing the dissociated metal precursor; and isolating the capped metal nanoparticles with an alkyl amine. The present invention provides a method for manufacturing metal nanoparticles which can be performed with simpler equipment compared to the gas phase method, can provide metal nanoparticles in high yield by only using alkyl amine without using any surfactant in high concentration which further allows mass production, and can provide metal nanoparticles having high dispersion stability and uniform size of 1-40 nm.

14 Claims, 3 Drawing Sheets

METHOD FOR MANUFACTURING METAL NANOPARTICLES

CROSS-REFERENCE TO RELATED APPLICATION

This application claims the benefit of Korean Patent Application No. 10-2007-0076556 filed on Jul. 30, 2007 with the Korea Intellectual Property Office, the contents of which are incorporated here by reference in their entirety.

BACKGROUND

1. Technical Field

The present invention relates to a method for manufacturing metal nanoparticles and more particularly, to a method for manufacturing metal nanoparticles which provides uniform particle size and allows mass production.

2. Description of the Related Art

There is a large demand for metal patterning of a thin film and forming a fine wiring on a substrate through the inkjet method in response to trends for electronic devices with greater densifications and smaller sizes. To this end, it is necessary to develop conductive ink made of metal nanoparticles having uniform shape, a narrow particle distribution, and excellent dispersibility.

There are various methods for manufacturing metal nanoparticles such as mechanical grinding method, co-precipitation method, spray, sol-gel method, electro-deposition method, and microemulsion method, etc. A problem associated with the co-precipitation method is that the method may difficult to control particle size, shape and particle distribution and problems associated with the sol-gel method are high production costs and difficulties in mass production. On the other hand, the microemulsion method provides easy control of particle size, shape and particle distribution but the process is complicate and thus not suitable for practical uses.

A conventional method for manufacturing nanoparticles in a solution has a limitation of concentration. That is, only a concentration of less than 0.01 M is used to produce nanoparticles having uniform size and even its production yield is very low. Thus, at least 1000 liter of a reactor is required to produce gram(g) volumes of nanoparticles having uniform size.

Silver nanoparticles have been produced by using thiol or fatty acid compound. The thiol compound has a strong bond with novel metals such as gold and silver and is able to control the particle size. The fatty acid compound is also able to control the particle size even though the bond with novel metals is less that the thiol compound. However, the amine compound has a weak bond with silver, so that it is difficult to produce stable silver nanoparticles.

Recently, a method for manufacturing gold or silver nanoparticles using silver acetate, oleylamine, and an organic solvent has been introduced. However, a reaction time is more than 8 hours and a yield is about 10% which is very low. In this method, phenylhydrazine can be used as a reducing agent to produce silver nanoparticles but it is a carcinogenic compound and thus not applicable for industrial production. Further, silver acetate is very costly and thus not suitable for mass production. Accordingly, such conventional methods are not suitable for mass production of metal nanoparticles having high dispersion stability in high yield.

SUMMARY

An aspect of the present invention is to provide a method for manufacturing metal nanoparticles in high yield by using a low price of a precursor in high concentration.

In order to resolve the problems associated with the conventional methods, the present invention provides a method for manufacturing metal nanoparticles, the method including:

dissociating at least one metal precursor chosen from silver, gold and palladium;

reducing the dissociated metal precursor; and isolating the capped metal nanoparticles with an alkyl amine.

According to an embodiment of the present invention, the metal precursor may be a silver precursor.

According to an embodiment of the present invention, the silver precursor may be at least one chosen from silver nitrate, silver acetate, and silver oxide.

According to an embodiment of the present invention, the metal precursor is added in a mole ratio of 0.1 to 1 with respect to the alkyl amine.

According to an embodiment of the present invention, the step of dissociating the metal precursor is performed by using C10 to C20 alkyl amine at a temperature of 60 to 150° C.

According to an embodiment of the present invention, the C10 to C20 alkyl amine may be at least one chosen from decylamine, dodecylamine, tetradecylamine, hexadecylamine, octadecylamine and oleylamine.

According to an embodiment of the present invention, the step of dissociating the metal precursor is performed by additionally adding C2 to C8 alkyl amine at a temperature of room temperature to 150° C.

According to an embodiment of the present invention, the C2 to C8 alkyl amine may be at least one chosen from ethylamine, propylamine, butylamine, hexylamine, and octylamine.

According to an embodiment of the present invention, the alkyl amine may be added in a mole ratio of 1 to 10 with respect to the metal precursor.

According to an embodiment of the present invention, the step of dissociating the metal precursor may further include adding a non-polar solvent.

According to an embodiment of the present invention, the non-polar solvent may be at least one chosen from toluene, hexane, cyclohexane, decane, dodecane, tetradecane, hexadecane, octadecane and octadecene.

According to an embodiment of the present invention, the non-polar solvent may be added in a mole ratio of 1 to 100 with respect to the metal precursor.

According to an embodiment of the present invention, in the step of reducing the dissociated metal precursor, a reducing agent or a catalyst may be added.

According to an embodiment of the present invention, the reducing agent may be at least one chosen from formic acid, ammonium formate, dimethylamine borane, ter-butylamine borane, and triethylamine borane.

According to an embodiment of the present invention, the reducing agent may be added in a mole ratio of 1 to 4 with respect to the metal precursor.

According to an embodiment of the present invention, the catalyst may be at least one chosen from Sn, Cu, Fe, Mg and Zn.

According to an embodiment of the present invention, the catalyst may be added in a mole ratio of 0.05 to 0.5 with respect to the metal precursor.

According to an embodiment of the present invention, the step of isolating the metal nanoparticles may be performed by using methanol or acetone or a mixture thereof.

The present invention provides a method for manufacturing metal nanoparticles which can be performed with a simpler equipment compared to the gas phase method, can provide metal nanoparticles in high yield by only using alkyl amine without using any surfactant in high concentration which further allows mass production, can provide metal nanoparticles having high dispersion stability and uniform size of 1-40 nm.

DETAILED DESCRIPTION

Figure 1:
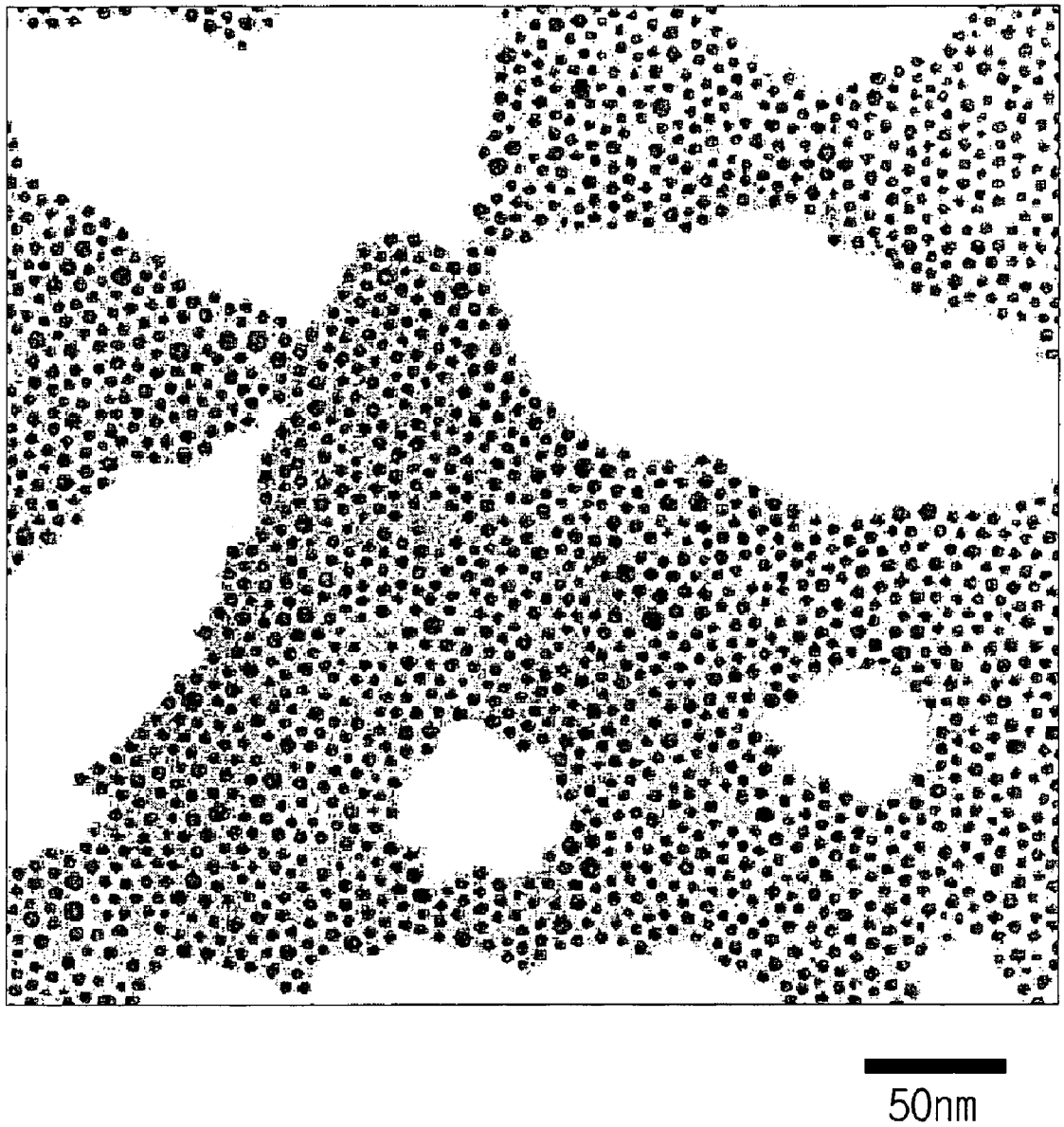
FIG. 1 is a TEM image of silver nanoparticles produced in Example 1.

Hereinafter, preferred embodiments will be described in detail of the method of producing metal nanoparticles according to the present invention.

A method for manufacturing metal nanoparticles according to the present invention include dissociating at least one metal precursor chosen from silver, gold and palladium; reducing the dissociated metal precursor; and isolating the capped metal nanoparticles with an alkyl amine.

Here, the metal precursor may be a metal salt in which the metal is at least one chosen form gold, silver, and palladium. According to an embodiment, the metal precursor may be chosen from $AgBF_4$, $AgCF_3SO_3$, $AgNO_3$, $AgClO_4$, $Ag(CH_3CO_2)$, $AgPF_6$ and $Ag_2O$.

The metal precursor is added in a mole ratio of 0.1 to 1 with respect to the alkyl amine. When a content of the metal precursor is less than 0.1 mole ratio, the metal precursor is not sufficiently dissociated, while it is more than 1 mole ratio, it brings excess use of alkyl amine which is not economical and lowers the productivity.

The step of dissociating the metal precursor may be divided into (i) direct using of alkyl amine used as capping molecule and (ii) additional adding of a small molecule of alkyl amine.

In the former case, alkyl amine, which can be used as a capping molecule, may have at least 10 carbons including decylamine, dodecylamine, tetradecylamine, hexadecylamine, octadecylamine and oleylamine, etc. This alkyl amine may not only function as a capping molecule but also dissociate the metal precursor.

A content of the alkyl amine used also as a capping molecule may be in a mole ratio of 1 to 10 with respect to the metal precursor. When the content is less than 1 mole ratio, the metal precursor is not sufficiently dissociated, while when it is more than 10 mole ratio, it brings excess use of alkyl amine which is not economical and lowers the productivity.

In case that the alkyl amine having at least 10 carbons is used to dissociate the metal precursor, when the temperature is lower than 60° C., the metal precursor may not be sufficiently dissociated, while it is higher than 150° C., it may cause severe exothermic reaction.

In the latter case, the small molecule of alkyl amine may be ethylamine, propylamine, butylamine, hexylamine, and octylamine, etc which has less than C8 carbons.

The small molecule of alkyl amine may be added in a mole ratio of 1 to 10 with respect to the metal precursor. When the content is less than 1 mole ratio, the metal precursor is not sufficiently dissociated, while when it is more than 10 mole ratio, it brings excess use of alkyl amine which is not economical.

In case that the small molecule of alkyl amine is used to dissociate the metal precursor, when the temperature is lower than room temperature, the metal precursor may not be sufficiently dissociated, while it is higher than 150° C., it may cause severe exothermic reaction.

Further, a non-polar solvent may be added additionally in the step of dissociating the metal precursor and its example may be toluene, hexane, cyclohexane, decane, dodecane, tetradecane, hexadecane, octadecane and octadecene. The non-polar solvent may control the reaction temperature and dilute the reaction mixture. The non-polar solvent may be added in a mole ratio of 1 to 100 with respect to the metal precursor. When the content is less than 1 mole ratio, it may not form a homogenous reaction solution, while when it is more than 100 mole ratio, it brings excess use of non-polar solvent which is not economical.

Any kind of reducing agent may be used in the step of reducing the dissociated metal precursor, a weak reducing agent may be preferably used and its example includes formic acid, ammonium formate, dimethylamine borane, ter-butylamine borane, and triethylamine borane, preferably a formate compound such as formic acid and ammonium formate.

The reducing agent may be added in a mole ratio of 1 to 4 with respect to the metal precursor. When the content of reducing agent is less than 1 mole ratio, it may lower the production yield due to insufficient reduction, while it is more than 4 mole ratio, it brings excess use of reducing agent which is not economical.

Any kind of catalyst may be used in the step of reducing the dissociated metal precursor, and metal examples of the catalyst include each salt of Sn, Cu, Fe, Mg, and Zn, etc. Since the metal catalyst has lower standard reduction potential than the metal of the metal precursor, the metal catalyst itself is oxidized and efficiently reduces the metal ions such as silver ions as shown in the following reaction equation.

$$Ag^{+}+M^{+z}\rightarrow Ag^{0}+M^{+(Z+1)}$$

Particular metal catalyst may be $Sn(NO_3)_2$, $Sn(CH_3CO_2)_2$, $Sn(acac)_2$, $Cu(NO_3)_2$, $Cu(CH_3CO_2)_2$, $Cu(acac)_2$, $FeCl_2$, $FeCl_3$, $Fe(acac)_2$, $Mg(NO_3)_2$, $Mg(CH_3CO_2)_2$, $Mg(acac)_2$, $Zn(CH3CO2)_2$, $ZnCl_2$, $Zn(acac)_2$, etc but is not limited to them.

The catalyst may be used in a mole ratio of 0.05 to 0.5 with respect to the metal precursor. When the content is less than 0.05 mole ratio, it lowers the production yield, while when the content is more than 0.5 mole ratio, it brings excess use of metal catalyst which is not economical.

A non-solvent such as methanol, acetone or a mixture of methanol and acetone may be used to isolate the metal nanoparticles in the step of isolating the capped metal nanoparticles with the alkyl amine but it is not limited to them.

The metal nanoparticles produced by the above described method are produced in high yield and have high dispersion stability of 1-40 nm, compared the metal nanoparticles produced by the conventional method.

EXAMPLE

While the present invention has been described with reference to particular embodiments, it is to be appreciated that various changes and modifications may be made by those skilled in the art without departing from the spirit and scope of the present invention, as defined by the appended claims and their equivalents. Throughout the description of the present invention, when describing a certain technology is determined to evade the point of the present invention, the pertinent detailed description will be omitted.

Hereinafter, although more detailed descriptions will be given by examples, those are only for explanation and there is no intention to limit the invention.

Example 1

Preparation of Metal Nanoparticles

Silver nitrate 34 g and oleylamine 300 g were stirred and heated to dissolve the silver nitrate to 80° C. The reaction mixture was yellow color and after the silver nitrate was completely dissolved, formic acid 8 g was added at room temperature. As soon as adding formic acid, the reaction mixture turned to dark brown with exothermic reaction. The reaction was performed for about 2 hours and then a mixture of acetone and methanol was added. Silver nanoparticles were obtained through a centrifuge and the produced silver nanoparticles were determined to have a size of about 7 nm.

Example 2

Preparation of Metal Nanoparticles using a Small Molecule of Alkyl Amine

Silver nitrate 34 g, oleylamine 120 g and toluene 250 ml were stirred and butylamine 30 g was added to easily dissociate silver nitrate while stirring. The reaction mixture was stirred and heated to 80° C. till turned to a clear solution. As soon as formic acid 8 g was added, the reaction mixture was turned to dark brown with exothermic reaction. The reaction was performed for about 2 hours and then a mixture of acetone and methanol was added. Silver nanoparticles were obtained through a centrifuge and the produced silver nanoparticles were determined to have a size of about 10 nm.

Example 3

Preparation of Metal Nanoparticles using a Metal Catalyst

Silver nitrate 34 g and oleylamine 300 g were stirred and heated to dissolve the silver nitrate to 80° C. The reaction mixture was yellow color and after the silver nitrate was completely dissolved, $Sn(ac)_2$ 10 g was added at room temperature. As soon as adding $Sn(ac)_2$, the reaction mixture turned to dark brown with exothermic reaction. The reaction was performed for about 2 hours and then a mixture of acetone and methanol was added. Silver nanoparticles were obtained through a centrifuge and the produced silver nanoparticles were determined to have a size of about 5 nm.

A TEM image of the silver nanoparticles produced in Example 1 is shown in FIG. 1. It is noted that the silver nanoparticles has uniform size of less than 10 nm as shown in FIG. 1.

Figure 2:
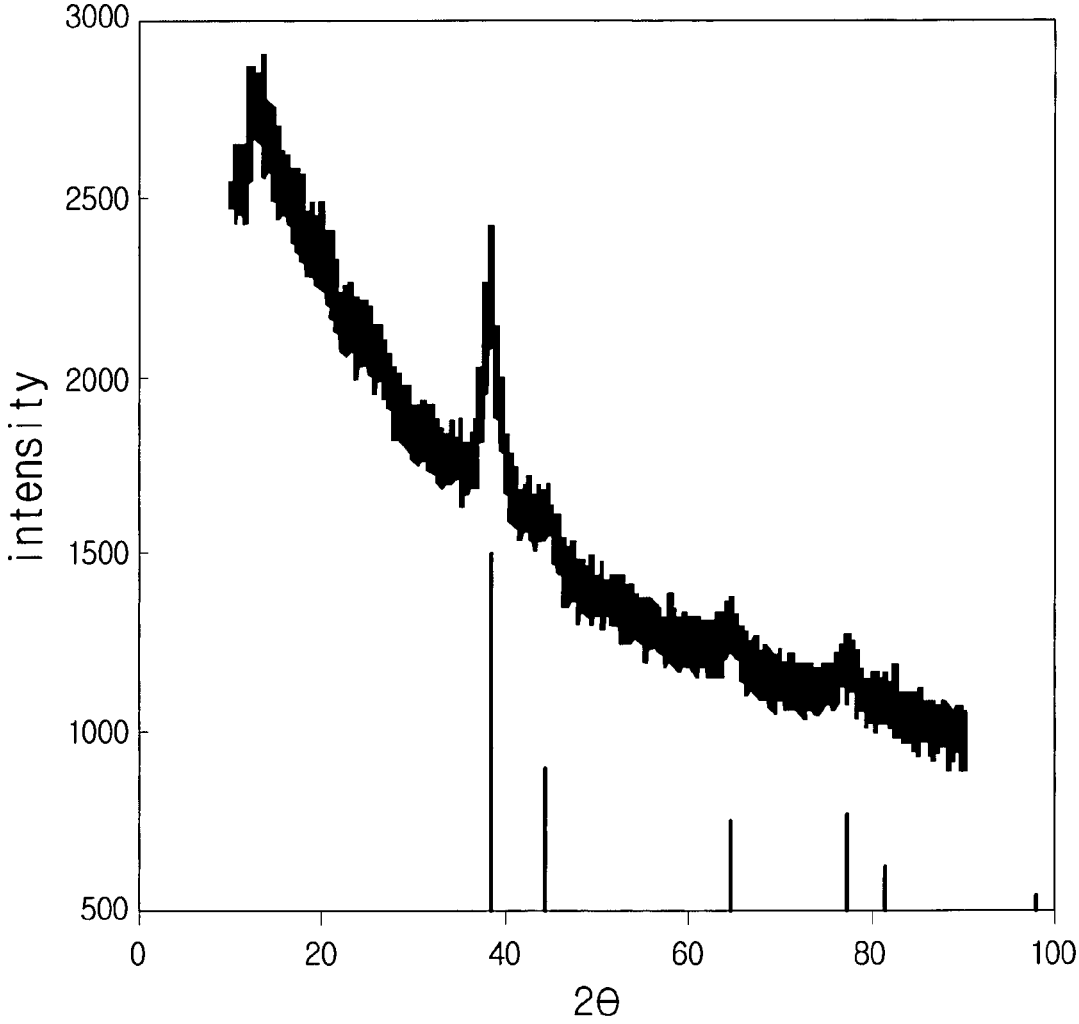
FIG. 2 is a PXRD analysis of silver nanoparticles produced in Example 1.

A PXRD analysis of the silver nanoparticles produced in Example 1 is shown in FIG. 2. It is noted that the silver nanoparticles having FCC (face-centered cubic) structure are produced as shown in FIG. 2.

Figure 3:
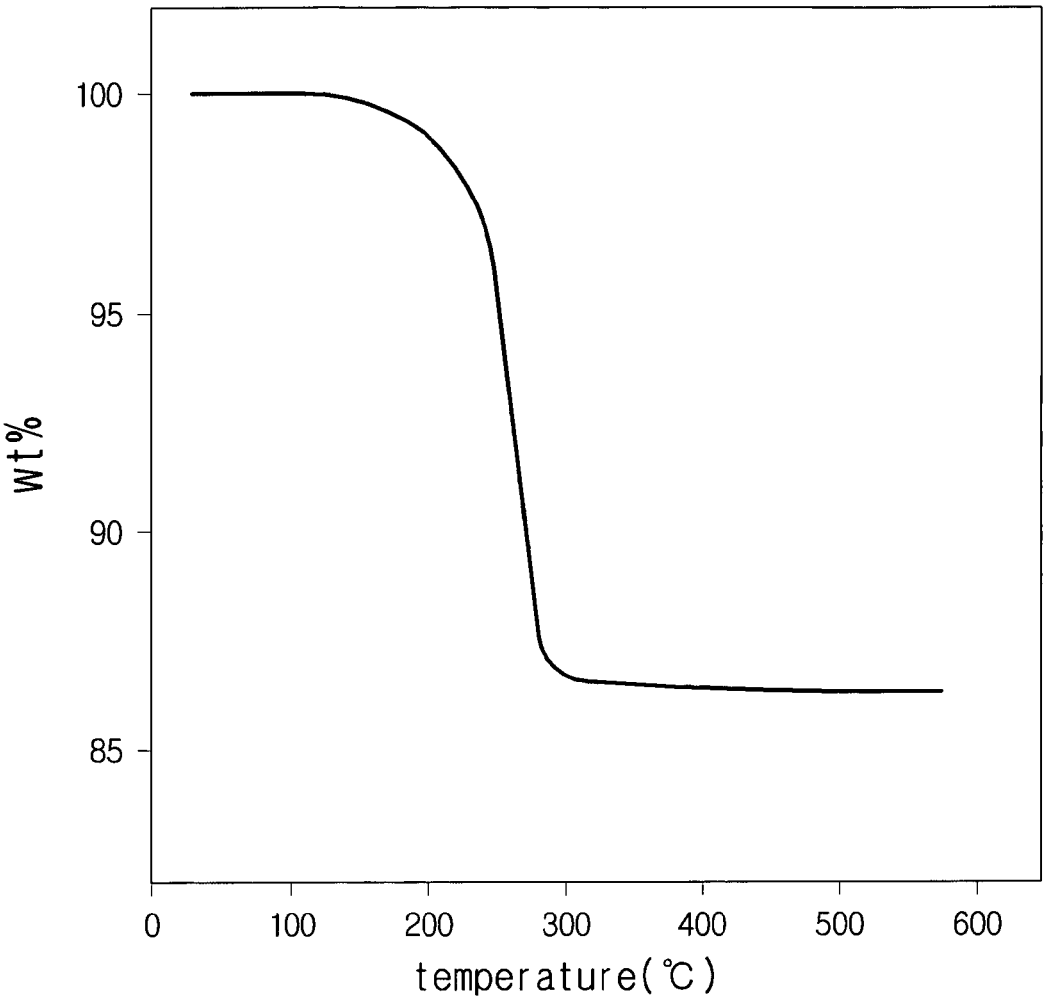
FIG. 3 is a TGA graph illustrating a content of an organic compound in silver nanoparticles produced in Example 1.

In addition, a TGA (thermogravimetric analysis) graph which provides a content of an organic compound in the silver nanoparticles produced in Example 1 is shown in FIG. 3. It is noted that the content of an organic compound in the silver nanoparticles, which is the capping molecule, is 15 wt % and when size of the silver nanoparticles changes from 1 nm to 20 nm, the content of an organic compound is reduced from 30 wt % to 5 wt %. It is also noted that the silver nanoparticles exhibit high dispersion stability.

What is claimed is:

1. A method for manufacturing metal nanoparticles, the method comprising steps of:

dissociating a precursor of at least one metal selected from the group consisting of silver, gold and palladium by using an alkyl amine;

reducing the dissociated metal in the presence of a catalyst; and isolating metal nanoparticles capped with the alkyl amine, wherein the catalyst is at least one selected from the group consisting of Sn, Cu, Fe, Mg and Zn.

2. The method of claim 1, wherein the metal precursor is a silver precursor.

3. The method of claim 2, wherein the silver precursor is at least one selected from the group consisting of silver nitrate, silver acetate, and silver oxide.

4. The method of claim 1, wherein the metal precursor is added in a mole ratio of 0.1 to 1 with respect to the alkyl amine.

5. The method of claim 1, wherein the step of dissociating the metal precursor is performed by using C10 to C20 alkyl amine at a temperature of 60 to 150° C.

6. The method of claim 5, wherein the alkyl amine is at least one selected from the group consisting of decylamine, dodecylamine, tetradecylamine, hexadecylamine, octadecylamine and oleylamine.

7. The method of claim 1, wherein the step of dissociating the metal precursor is performed by additionally adding C2 to C8 alkyl amine at a temperature of room temperature to 150° C.

8. The method of claim 7, wherein the C2 to C8 alkyl amine is at least one selected from the group consisting of ethylamine, propylamine, butylamine, hexylamine, and octylamine.

9. The method of claim 1, wherein the alkyl amine is added in a mole ratio of 1to 10 with respect to the metal precursor.

10. The method of claim 1, wherein in the step of dissociating the metal precursor, a non-polar solvent is added.

11. The method of claim 10, wherein the non-polar solvent is at least one selected from the group consisting of toluene, hexane, cyclohexane, decane, dodecane, tetradecane, hexadecane, octadecane and octadecene.

12. The method of claim 10, wherein the non-polar solvent is added in a mole ratio of 1 to 100 with respect to the metal precursor.

13. The method of claim 1, wherein the catalyst is added in a mole ratio of 0.05 to 0.5 with respect to the metal precursor.

14. The method of claim 1, wherein the step of isolating the metal nanoparticles is performed by using methanol, acetone, or a mixture thereof.

* * * * *